US008112860B2

(12) United States Patent
Collins

(10) Patent No.: US 8,112,860 B2
(45) Date of Patent: Feb. 14, 2012

(54) METHOD OF TREATING GLAZING PANELS

(76) Inventor: Stephen Collins, Ottawa (CA)

( * ) Notice: Subject to any disclaimer, the term of this patent is extended or adjusted under 35 U.S.C. 154(b) by 1589 days.

(21) Appl. No.: 10/995,137

(22) Filed: Nov. 24, 2004

(65) Prior Publication Data

US 2005/0144863 A1 Jul. 7, 2005

Related U.S. Application Data

(60) Provisional application No. 60/529,882, filed on Dec. 17, 2003, provisional application No. 60/548,155, filed on Feb. 27, 2004.

(51) Int. Cl.
*E06B 3/677* (2006.01)
*E06B 7/00* (2006.01)

(52) U.S. Cl. ..... 29/402.01; 52/786.13; 52/514; 52/204.52; 454/198; 454/207; 454/212; 428/34

(58) Field of Classification Search ..... 52/202, 52/203, 171.3, 172, 204.52, 209, 514, 198, 52/786.1, 786.13; 29/896.62, 451, 525.13, 29/557; 454/196, 206, 211, 213, 214, 222, 454/223, 198, 207, 212; 428/34
See application file for complete search history.

(56) References Cited

U.S. PATENT DOCUMENTS 190,533 A * 5/1877 Anthony et al. ..... 454/198
875,300 A * 12/1907 Sykes ..... 454/198
1,478,312 A * 12/1923 Wenger ..... 454/198
1,703,230 A * 2/1929 Gillar ..... 52/209
1,998,671 A * 4/1935 Hadjisky ..... 52/209
2,071,811 A * 2/1937 Bartuska et al. ..... 52/172
2,125,372 A * 8/1938 Fox ..... 52/204.52
2,159,661 A * 5/1939 Knudsen ..... 52/1
2,182,852 A * 12/1939 Mulford ..... 52/22
2,189,465 A * 2/1940 Haley et al. ..... 52/171.2
2,202,694 A * 5/1940 Haux ..... 52/204.52
2,207,745 A * 7/1940 Lipsett ..... 52/209
2,233,952 A * 3/1941 Lipsett ..... 52/204.52
(Continued)

FOREIGN PATENT DOCUMENTS

CA 433834 3/1948
(Continued)

OTHER PUBLICATIONS

Condo Living, Site Seeing, Jan. 31, 2004, Toronto Star, "They Do Windows".

*Primary Examiner* — Robert J Canfield

(57) ABSTRACT

The present invention relates to a method of treating a glazing panel from an inside location. Moreover, the present invention relates to a method of treating glazing panels used in windows and patio doors. Initially, a hole is formed on both inside and outside panes on windows and on the side and outside frames of patio doors. Next, a filter is attached to the outside pane to cover the hole whereby the filter membrane is designed to allow the passage of air and inhibit the ingress of moisture. Finally, a seal is used to cover the hole on the inside pane or to ensure that the building air does not enter the interior of the glazing panel. Where the panes are tempered glass, the hole(s) may be drilled through the frame. If necessary, one or more tubes may be inserted through the hole. Various kinds of filters are disclosed.

14 Claims, 12 Drawing Sheets

U.S. PATENT DOCUMENTS

| | | | | | |
|---|---|---|---|---|---|
| 2,302,740 | A | * | 11/1942 | Boicey | 52/204.52 |
| 2,345,643 | A | * | 4/1944 | Verhagen | 52/209 |
| 2,387,119 | A | | 10/1945 | Clerk | |
| 2,621,397 | A | * | 12/1952 | Black | 228/124.6 |
| 2,756,467 | A | * | 7/1956 | Etling | 428/34 |
| 2,775,028 | A | * | 12/1956 | Wampler | 29/455.1 |
| 2,784,462 | A | * | 3/1957 | Fix | 156/109 |
| 2,795,018 | A | * | 6/1957 | Shaw | 65/36 |
| 2,805,452 | A | * | 9/1957 | Englehart | 29/458 |
| 2,880,475 | A | * | 4/1959 | Mills | 52/204.52 |
| 2,886,864 | A | * | 5/1959 | Boicey et al. | 65/43 |
| 2,887,737 | A | * | 5/1959 | Prescott | 65/43 |
| 2,887,738 | A | * | 5/1959 | Prescott et al. | 65/43 |
| 3,914,180 | A | * | 10/1975 | Boller et al. | 508/589 |
| 3,971,178 | A | * | 7/1976 | Mazzoni et al. | 52/172 |
| 4,155,205 | A | | 5/1979 | Polman | |
| 4,332,111 | A | * | 6/1982 | Terashima | 52/1 |
| 4,394,806 | A | * | 7/1983 | Day | 52/172 |
| 4,450,660 | A | | 5/1984 | Dean et al. | |
| 4,464,260 | A | * | 8/1984 | Duneau | 210/232 |
| 4,483,108 | A | * | 11/1984 | Howard | 451/41 |
| 4,520,602 | A | * | 6/1985 | Miller | 52/171.3 |
| 4,567,703 | A | * | 2/1986 | Ricks | 52/204.52 |
| 4,587,784 | A | * | 5/1986 | Chavy et al. | 52/204.52 |
| 4,592,179 | A | * | 6/1986 | Boutarin | 52/172 |
| 4,616,561 | A | * | 10/1986 | Giocastro | 454/213 |
| 4,627,206 | A | * | 12/1986 | Cox | 52/209 |
| 4,656,803 | A | * | 4/1987 | Chludil | 52/209 |
| 4,660,271 | A | * | 4/1987 | Lenhardt | 29/527.4 |
| 4,691,487 | A | * | 9/1987 | Kessler | 52/209 |
| 4,787,296 | A | * | 11/1988 | Huang | 454/212 |
| 4,835,926 | A | * | 6/1989 | King | 52/171.3 |
| 4,846,970 | A | | 7/1989 | Bertelsen et al. | |
| 4,856,508 | A | | 8/1989 | Tayebi | |
| 4,893,443 | A | * | 1/1990 | Haber | 528/208 |
| 4,952,430 | A | * | 8/1990 | Bowser et al. | 428/34 |
| 5,299,399 | A | * | 4/1994 | Baier et al. | 52/204.52 |
| 5,596,151 | A | * | 1/1997 | Rossini | 73/861.55 |
| 5,664,395 | A | * | 9/1997 | Collins et al. | 52/786.13 |
| 5,890,331 | A | * | 4/1999 | Hope | 52/209 |
| 6,054,195 | A | * | 4/2000 | Collins et al. | 428/34 |
| 6,242,391 | B1 | * | 6/2001 | Fukutani et al. | 508/180 |
| 6,365,242 | B1 | * | 4/2002 | Veerasamy | 428/34 |
| 6,383,580 | B1 | * | 5/2002 | Aggas | 428/34 |
| 6,430,894 | B1 | * | 8/2002 | Chae et al. | 52/786.1 |
| 6,442,911 | B2 | * | 9/2002 | Elmer et al. | 52/506.01 |
| 6,463,706 | B1 | * | 10/2002 | Guhl et al. | 52/204.62 |
| 6,553,728 | B1 | * | 4/2003 | Zurn | 52/171.3 |
| 6,676,786 | B1 | * | 1/2004 | Collins et al. | 156/104 |
| 6,804,924 | B2 | * | 10/2004 | Zurn et al. | 52/514 |
| 6,889,480 | B2 | * | 5/2005 | Guhl et al. | 52/786.1 |
| 6,916,392 | B2 | * | 7/2005 | Trpkovski et al. | 156/104 |
| 7,134,251 | B2 | * | 11/2006 | Zurn et al. | 52/514 |
| 7,281,686 | B2 | * | 10/2007 | Wood | 244/129.3 |
| 7,293,391 | B2 | * | 11/2007 | Guhl et al. | 52/204.593 |
| 2003/0233919 | A1 | * | 12/2003 | Yourkievitz et al. | 83/35 |
| 2005/0006313 | A1 | * | 1/2005 | Swinnen et al. | 210/748 |
| 2005/0132558 | A1 | * | 6/2005 | Hennessy et al. | 29/525 |
| 2005/0144863 | A1 | * | 7/2005 | Collins | 52/204.5 |
| 2007/0033887 | A1 | * | 2/2007 | Ambrose | 52/171.3 |

FOREIGN PATENT DOCUMENTS

| | | | | |
|---|---|---|---|---|
| CA | 504946 | | | 8/1954 |
| CA | 629805 | | | 10/1961 |
| CA | 1113789 | | | 12/1981 |
| CA | 1243243 | | | 10/1988 |
| CA | 1332541 | | | 10/1994 |
| CA | 2 447 781 | A1 | * | 11/2004 |
| CH | 670476 | A | * | 6/1989 |
| DE | 1 064 231 | | | 8/1959 |
| DE | 3406423 | A | * | 8/1985 |
| DE | 3631808 | A | * | 4/1988 |
| DE | 3903040 | A1 | * | 3/1990 |
| EP | 0 677 581 | | | 8/1952 |
| EP | 064 469 | | | 11/1982 |
| EP | 1 367 211 | | | 12/2003 |
| FR | 2560536 | A1 | * | 9/1985 |
| FR | 2671128 | | | 7/1992 |
| FR | 2671373 | A1 | * | 7/1992 |
| GB | 2039028 | A | * | 7/1980 |

* cited by examiner

METHOD OF TREATING GLAZING PANELS

CROSS-REFERENCE TO RELATED APPLICATIONS

This application claims priority from U.S. Provisional patent application Ser. No. 60/529,882 filed Dec. 17, 2003 naming the present inventor. This application also claims priority from U.S. Provisional patent application Ser. No. 60/548,155 filed Feb. 27, 2004 naming the present inventor. This application also claims priority from U.S. patent application Ser. No. 10/918,346 filed Aug. 16, 2004, which should have named the present inventor but erroneously failed to do so. The contents of these three applications are incorporated herein by reference.

FIELD OF INVENTION

This invention relates to glazing panels comprising at least two panes with a sealed air space therebetween, and methods of treating same, and is especially concerned with removing from the air space contamination, such as condensation and/or particulate matter, and/or preventing ingress of such contamination.

BACKGROUND

Known glazing panels comprise two or more panes of glass spaced apart a short distance and the gap between them sealed peripherally either by a spacer or the frame of the window, patio door, or other opening in which it is installed.

In use, such a glazing panel may develop one or more leaks in the peripheral seal, allowing moist air and/or other contamination to enter the air space. In other cases, vent holes provided to avoid excessive pressure/vacuum build up as the glazing panel is heated or cooled may admit such moist air and/or contamination. Under certain conditions, moisture may condense out of the air within the air space and form condensation on the inner surface of at least one of the panes. This reduces visibility through the panel. Even if the glazing panel warms up and the moisture evaporates, it may leave a deposit of minerals, for example, on the pane, again reducing visibility. Moreover, it is also possible for other forms of contamination, such as particulate matter, to be drawn into the air space as the panel cools and a partial vacuum is created within it.

A method of removing and/or preventing condensation and contaminant buildup in glazing panels is described in Canadian patent No. 1,332,541, to which the reader is directed to for reference. The method involves forming at least one hole in the external pane, removing condensation and/or contamination from the air space, and then attaching a filter means in the form of a patch to close the hole. The filter contains interstices sized to allow moisture to be expelled from the panel as the window heats, but restrict ingress of water droplets as air is drawn back into the panel as it cools.

This method is not entirely satisfactory, however, but has certain limitations and disadvantages, at least for some applications.

The present invention seeks to eliminate, or at least mitigate, the limitations and disadvantages of such known method, or at least provide an alternative.

One specific disadvantage of such known method is that it may be difficult to gain access to the outside of the glazing panel, perhaps because it is installed in a high-rise building.

Embodiments of a first aspect of the present invention address this disadvantage by drilling the hole in the external pane of a glazing panel via a generally aligned hole in the interior pane.

Thus, according to this first aspect of the present invention there is provided a method of treating a glazing panel to remove contamination from and/or inhibit ingress of contamination into an enclosed air space of the glazing panel, the glazing panel comprising at least an exterior pane and an interior pane and spacing and sealing means extending around and sealing the perimeters of the panes to form said enclosed air space therebetween, said method comprising the steps of:

(i) creating an access hole in the interior pane from its surface furthest from the exterior pane, said access hole communicating with the air space;

(ii) through the access hole, creating a vent hole in the exterior pane through which hole the air space communicates with ambient air;

(iii) applying a filter means to the vent hole to filter air passing therethrough; and (iv) sealing the access hole, wherein the vent hole is located at a position lower than that of the access hole.

Another disadvantage of such known method is that it cannot readily be applied where the glazing panel comprises tempered glass panes, such as are used in patio doors, since drilling a hole in such a pane may cause the glass to shatter.

Embodiments of the present invention address this disadvantage by dispensing with drilling holes through the panes, and instead drilling the required hole or holes through the frame so that the air space communicates with the ambient through the frame supporting the panes. Thus, such embodiments provide a method of treating a sealed glazing unit installed into a surrounding frame and comprising at least an exterior pane and an interior pane, and spacing and sealing means extending around and sealing the perimeters of the panes to provide an air space therebetween, the frame having a side face adjacent each pane and an edge surface generally perpendicular to the panes and directed outwardly therefrom, the method comprising the steps of:

(i) drilling at least one vent hole from an external face of the frame of the installed glazing unit for providing air flow communication through the frame and between the air space and ambient, and (ii) applying a filter means to the vent hole to filter air passing between the air space and ambient.

Thus, employing a method according to embodiments of the invention results in a sealed glazing unit comprising at least an exterior pane and an interior pane, spacing and sealing means extending around and sealing the perimeters of the panes to provide an enclosed air space therebetween and a frame surrounding the glazing unit, the frame having a side region adjacent the means extending around and sealing the perimeters of the panes and an outer region, venting means for providing air flow communication between the air space and ambient air, said venting means being formed within the frame surrounding the glazing unit; and filter means attached to a region of the venting means for filtering air passing between the air space and ambient said filter means comprising means for permitting the egress of moisture-laden air from the air space when the air space temperature and pressure are elevated relative to ambient and inhibiting the ingress of moisture droplets from ambient air when the temperature and pressure of the air in the air space are less than ambient.

Where this entails drilling through a compartment containing desiccant, the desiccant may be lost through the drilled hole. Likewise, where the frame comprises an extrusion with compartments defined by structural webs and flanges, the buildup of moist air between the air space and ambient may occur.

Methods embodying the invention may provide a sealed glazing unit comprising at least an exterior pane and an interior pane, spacer means supporting the perimeters of the panes to provide an enclosed air space therebetween and a frame surrounding the glazing unit, the frame having a side face adjacent each pane and an edge surface perpendicular to the panes and directed outwardly therefrom, and venting means comprising a passageway extending through the frame to provide air flow communication between the air space and ambient air and a filter for filtering air passing through the passageway between the air space and ambient, said passageway comprising a tubular insert extending at least partially through the spacer means.

Methods embodying the present invention may provide, a sealed glazing unit comprising at least an exterior pane and an interior pane, spacer means supporting the perimeters of the panes to provide an enclosed air space therebetween and a frame surrounding the glazing unit, the frame having an interior flange and an exterior flange extending across and engaging respective margin portions of the outmost surfaces of the interior and exterior panes, respectively, said interior and exterior flanges being integral with the frame, venting means extending through the frame for providing air flow communication between the air space and ambient air; and filter means for filtering air passing through the venting means between the air space and ambient, said filter means comprising means for permitting the egress of moisture-laden air from the air space when the air space temperature and pressure are elevated relative to ambient and inhibiting the ingress of moisture droplets from ambient air when the temperature and pressure of the air in the air space are less than ambient.

Yet another disadvantage is that there is a trade-off between hole size and filter size. Thus, it is desirable to keep the diameter of the hole small so as to make it quicker and easier to drill and reduce the risk of breakage, but it is desirable for the open area of the filter, i.e., the aggregate area of the interstices, to be as great as possible so as to reduce resistance to air flow.

Thus, in embodiments of a sixth aspect of the present invention, there is provided a filter having a surface area greater than the planar area bounded by its perimeter.

Filter means for use with methods of the present invention when treating a glazing panel comprising at least an exterior pane and an interior pane and means extending around and sealing the perimeters of the panes to provide an internal air space therebetween, one of the interior or exterior panes having a hole, may comprise a marginal region for attaching the filter to said hole and a medial region comprising a membranous filter screen having interstices sized to permit the egress of moisture-laden air from the panel when its interior temperature and pressure are elevated relative to ambient and to inhibit ingress of moisture droplets with ambient air when the interior temperature and pressure of the air in the air space are greater than ambient, said membranous filter screen being non-planar so that its surface area is greater than its plan area.

Preferably, the filter is non-planar, conveniently dome-shaped, corrugated, or of other non-planar form, so that its surface area is increased as compared with a flat filter of the same perimeter.

It may also be disadvantageous to have a filter patch that is applied to the outside surface of the exterior pane, i.e., so that its margin overlies the exterior surface around the hole, since, even though the patch may protrude only slightly from the surface of the glass, it could impede the cleaning of the panel and generally can only be applied from the exterior of the panel. Moreover, such a patch may be unsightly.

These limitations may be addressed by means of a filter that is supported within the interior of the hole and preferably does not protrude from the surface of the pane.

Thus, methods embodying the present invention may employ filter means comprising a filter screen at least peripheral regions of which are resilient so that, upon insertion of the filter into a hole slightly smaller than the filter, the peripheral regions of the filter engage an interior of the hole to retain the filter therein.

Conveniently, the filter may be slightly larger than the hole and resilient so that it can be compressed to fit into the hole and its peripheral regions grip the interior of the hole. The filter may be dome-shaped and/or have at least its margins corrugated or crimped.

Alternatively, the filter may take the form of a patch applied to the interior surface of the exterior pane so that its margin portion overlies the glass surrounding the hole in the exterior pane.

Hence, the filter means may be installed by passing the filter means through the first hole, and adhering the filter to the interior surface of the exterior pane surrounding the second hole so that the filter covers the internal mouth of the hole.

Preferably, the filter is of magnetic material and a probe having a magnetic tip is used to install it, the filter being attached to the magnetic tip of the probe which is then inserted through the first hole and pressed into position until it adheres to the material surrounding the hole in the exterior pane. The probe then is withdrawn, the adhesion being sufficient to detach the filter from the magnetic tip. The filter may be adhered by means of a contact adhesive applied to its margins. Alternatively, adhesive may be applied to the interior surface, conveniently by means of a suitable probe, before the filter is pressed into place.

The filter may then comprise a flat filter or a dome-shaped filter with the dome protruding towards the interior pane. In either case, the filter may comprise a medial filter membrane supported by a surrounding annular part that adheres to the pane. The annular part may be integral with the membrane or a washer of a different material, e.g. vinyl, attached to the membrane.

The filter may take the form of a perforated membrane as disclosed in the above-mentioned Canadian patent No. 1,332,541. Alternatively, and especially where the filter is in the form of a patch, the filter portion itself may comprise at least one very thin slit in the patch, the width of the slit being small enough to limit ingress of moisture droplets and/or other contamination, the length of the slit being sufficient to provide the required open area.

Thus, a method embodying the present invention, for treating a glazing panel comprising at least an exterior pane and an interior pane and means supporting the perimeters of the panes to provide an internal air space therebetween, either of the panes having a through hole, said may employ filter means being adapted to attach to either of the panes and filter air passing through said hole, said filter means comprising a patch having one or more thin slits therein, the width of the one or more slits being narrow enough to limit ingress of moisture droplets from ambient air when the temperature and pressure of the air in the air space are less than ambient and wide enough to permit the egress of moisture-laden air from the air space temperature and pressure are elevated relative to ambient and the overall length of the one or more slits being determined so as to provide a required open area for the filter.

Preferably, the slit is non-linear.

The patch may have a central dome surrounded by a substantially flat annular portion, the slit extending, parallel to the flat annular portion, around a part of the base of the dome. Preferably, when such a patch is installed on the exterior of the external pane, the slit is directed downwards to that it is protected by the dome against ingress of rainwater.

Another disadvantage of known, window panels is they are susceptible to damage from pressure changes, which is a problem encountered in certain environments.

Embodiments of tenth aspect of the present invention address this limitation by providing a method of treating a glazing panel by drilling a hole in the exterior pane of a glazing panel via a generally aligned hole in the interior pane.

According to yet another aspect of the present invention, there is provided a method of treating a sealed glazing unit installed into a surrounding frame and comprising at least an exterior pane and an interior pane and spacing and sealing means extending around and sealing the perimeters of the panes to provide an air space therebetween, the frame having a side face adjacent each pane and an edge surface generally perpendicular to the panes and directed outwardly therefrom, the method comprising the steps of:

(i) creating a vent hole having a first portion and a second portion, the first portion of the vent hole extending through the frame from said edge surface and through the spacing and sealing means, said first portion of the vent hole communicating at one end with the air space, and the second portion of the vent hole extending from said side face of the frame to communicate with the first portion of the vent hole, such that the vent hole provides air flow communication through the frame and between the air space and ambient;

(ii) installing a filter means to close the second portion of the vent hole and filter air passing between the air space and ambient; and (iii) sealing the first portion of the vent hole exteriorly of the position at which it communicates with the second portion of the vent hole.

BRIEF DESCRIPTION OF DRAWINGS

Embodiments of the present invention will now be described, by way of example only, with reference to the attached drawings, wherein.

DETAILED DESCRIPTION

Figure 1:
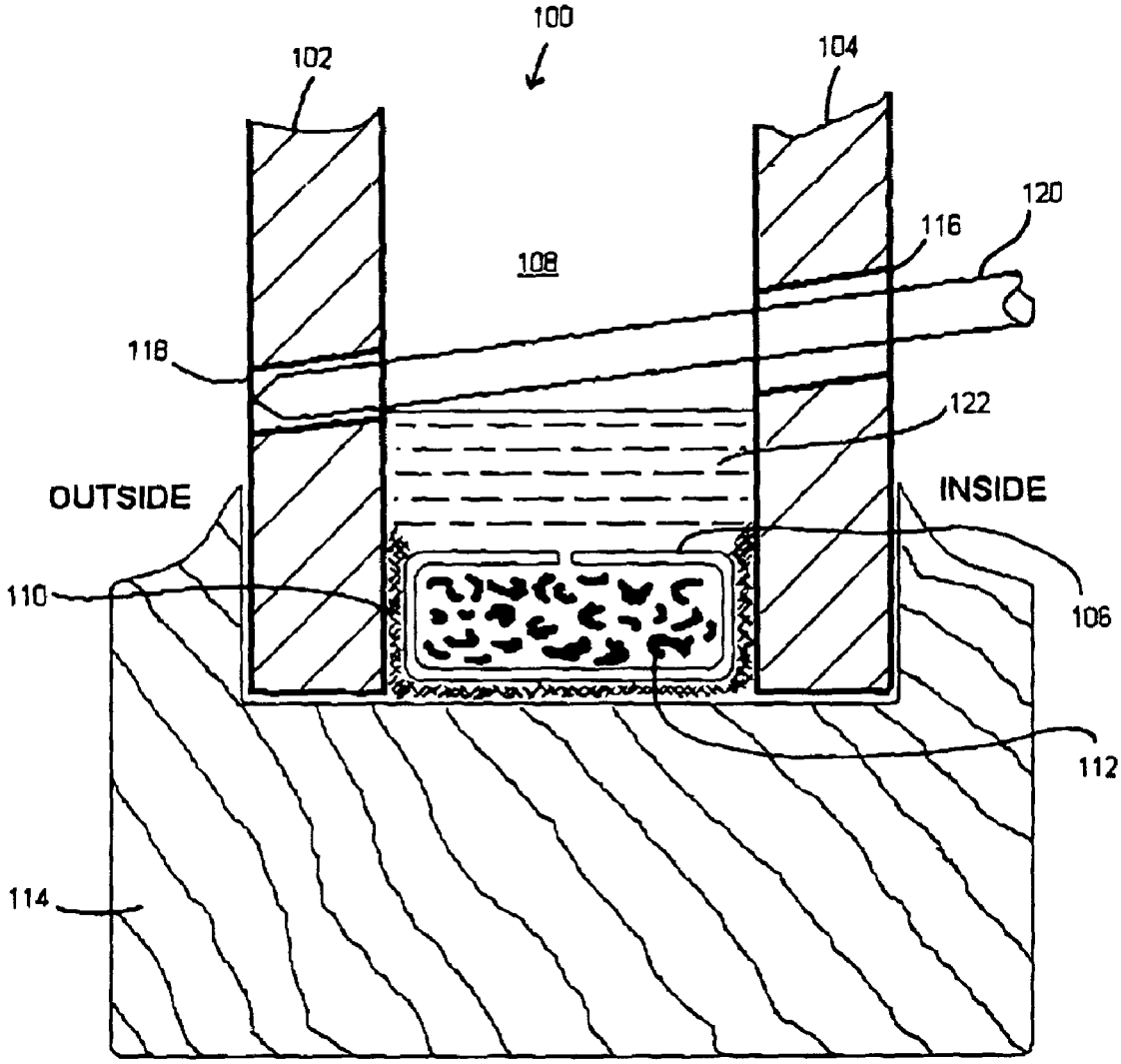
FIG. 1 is a cross-sectional view through the peripheral portion of a double glazing panel during treatment by a method according to a first aspect of the invention.

Referring to FIG. 1, a glazing panel 100 comprises a first glazing pane 102 (the outer pane when installed) and a second glazing pane 104 (the inner pane when installed) separated by a peripheral spacer 106 to enclose an air space 108. The spacer 106 is adhered to the peripheries of both panes by suitable sealant 110 to form an air-tight seal. The spacer 106 is hollow, conveniently an aluminium extrusion, and contains a desiccant material 112 installed during manufacture. The glazing panel 100 is supported by the usual frame 114 which, as shown, is made of wood, but may be any conventional material.

The desiccant 112 usually is installed during manufacture to remove moisture from the air within the air space 108, though not all double glazing panels will have it. In either case, over a period of time, leaks may occur in the peripheral seal, allowing moisture and/or particulate contamination to enter the panel and reduce visibility. Even if desiccant is installed during manufacture, it is likely that it will not be able to deal with such moisture.

A method of removing such contamination will now be described with additional reference to FIGS. 2, 3 and 4.

A first step is to drill a first hole 116 through the inner glazing pane 104 at a position close to the edge of the frame 114, preferably within about 2.5 cm. of the corner. Following cleaning of the area, the hole 116 is drilled, at a slightly downward angle, using a drilling device such as a Dremel™ rotary tool. During the drilling process, the drill and surrounding area are rinsed with cutting fluid, e.g. alcohol, which removes glass particles or shavings.

Preferably the drilling is stopped just before the drill tip breaks through into the air space. The hole is cleaned out and then the residual disc of glass pushed into the air space to fall to the bottom of the panel. This reduces the risk of glass particles falling into the air space and sticking to the interior surface of the glass.

A second hole 118 is drilled through the outer glazing pane 102 at a position that is slightly below the hole 116 of the inner pane 104. As shown in FIG. 1, the outer hole 118 is drilled via the first hole 116, i.e., from the interior of the building in which the panel is installed. Accordingly, the diameter of inner hole 116 is slightly larger than the outer hole 118 so as to provide adequate clearance for the drill bit 120 used to drill the outer hole and, as will be described later, a probe used to insert the filter. For example, the inner hole 116 might have a diameter of 5 to 6 mm and the outer hole 118*a* diameter of 3 to 4 mm. As can be seen from FIG. 1, both holes 116 and 118 slope downwards towards the exterior of the panel 100. The sloping of outer hole 118 helps to inhibit ingress of contamination.

While drilling of the outer hole 118 is taking place, the air space 108 is flooded with alcohol (122) to just below the bottom of inner hole 116. In addition to acting as a cutting fluid for the drill, the alcohol keeps the minute particles of glass, i.e., glass swarf, in suspension. Once the drill breaks through, the glass particles will tend to flow with the alcohol through the hole 118. If required, the alcohol may be replenished continuously during this process.

The alcohol is then allowed to evaporate off. If desired, however, another hole may be drilled through the inner pane 104 adjacent the bottom of the panel and used to drain and recover the bulk of the alcohol, the residue being allowed to evaporate. Such a drain hole may also be used to flush any glass swarf from either drilling operation out of the panel.

If desired, the drain hole can be drilled before the access hole 116 and the bottom region of the interior of the panel filled with alcohol to test whether or not it will leak from the base of the panel during subsequent steps.

Depending upon the degree of contamination of the surfaces of the panes, cleaning fluid may be passed through the air space and rinsed off, conveniently by means of one or more holes (not shown) drilled at other corners of the panel. The cleaning process described in Canadian patent number 1,332,541, for example, may be used.

Figure 2:
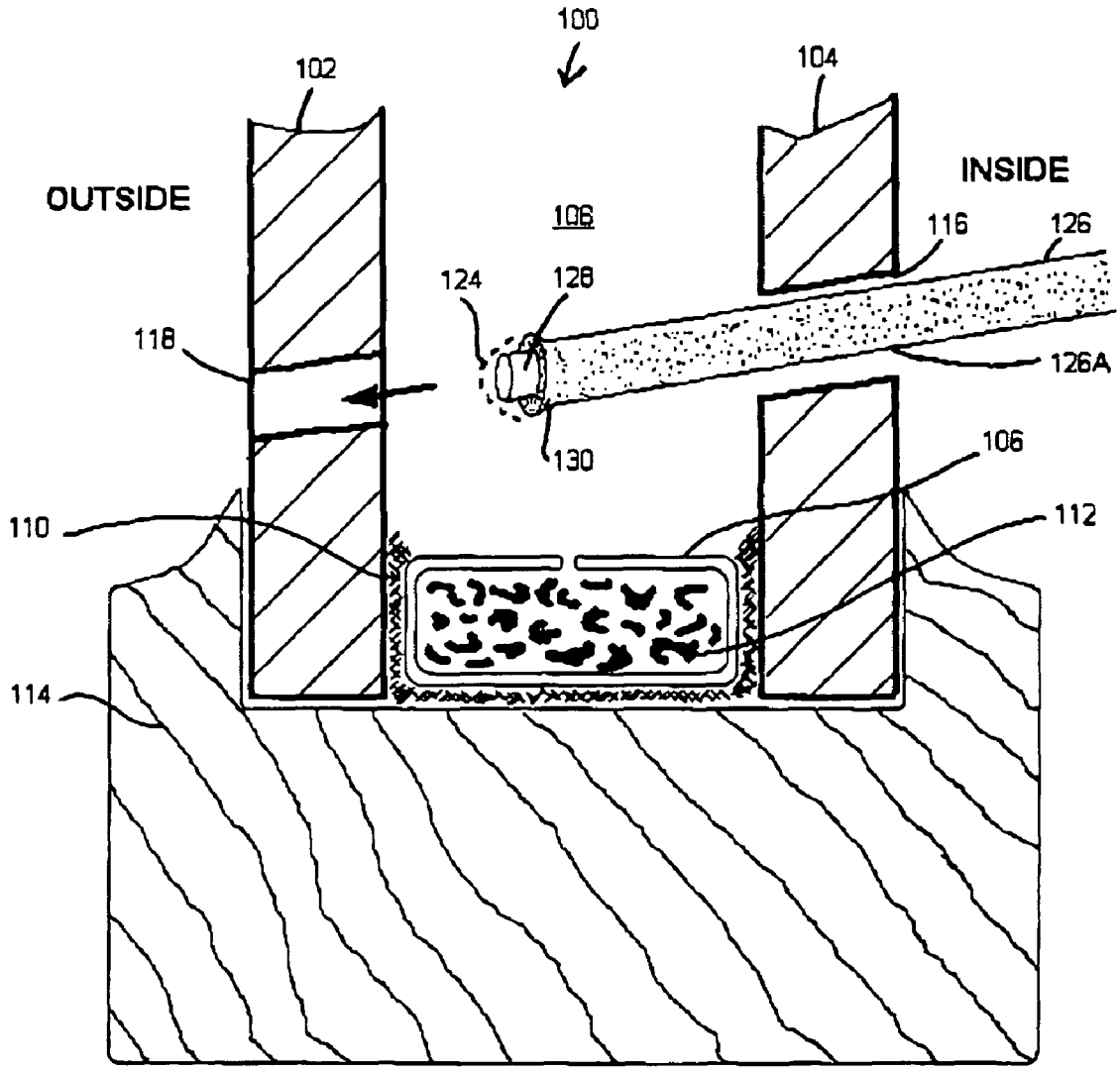
FIG. 2 is a cross-sectional view similar to FIG. 1 illustrating insertion of a filter.

As shown in FIG. 2, a stainless steel mesh filter 124 then is inserted into the outer hole 118 using a probe 126 with a magnetic tip 128. The filter 124 is domed (not quite a hemisphere) and, prior to insertion, has a base diameter slightly larger than the diameter of hole 118. The filter 124 is placed over the magnetic tip 128 which then is passed through inner hole 116 and pushed into hole 118 until the extremities of the filter 124 grip the interior surface of the hole 118 with sufficient force that, as the probe is withdrawn, the filter disengages from the magnetic tip 128 and remains fixed in the hole 118. The probe shank 126A is larger in diameter than both the magnetic tip 128 and the outer hole 118. Consequently, abutment of the end face 130 of the probe shank against the glass around the hole 118 shoulder prevent the filter from being inserted too far into the hole 118 and, importantly, being pushed so far that it falls out at the other end.

Figure 3:
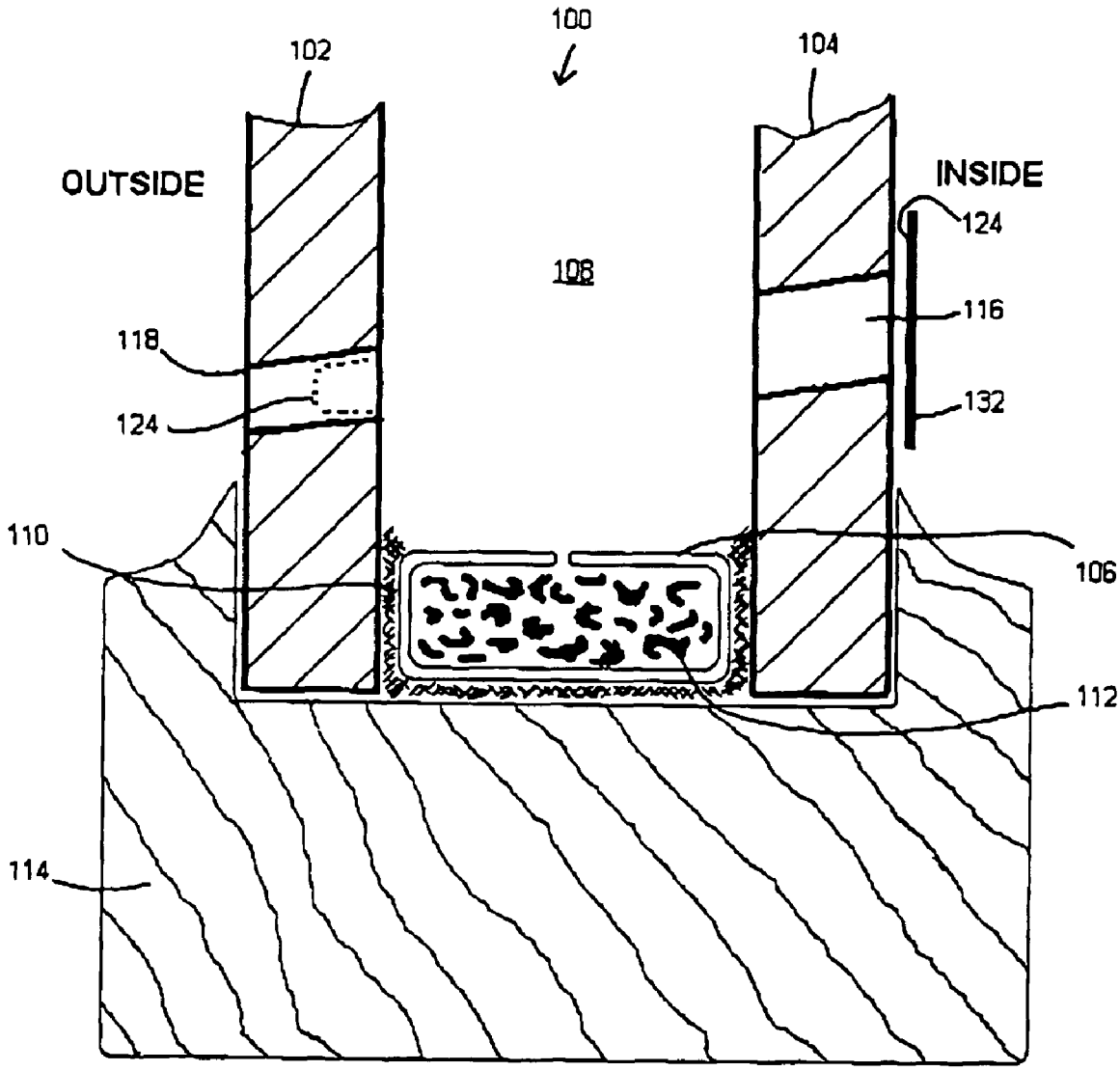
FIG. 3 is a cross-sectional view similar to FIG. 1 of the panel with the filter installed.

As shown in FIG. 3, a seal 132, e.g. a self-adhesive vinyl patch, is adhered to the inside of the inner pane 104 over the hole 116 to ensure that the building air does not enter the interior of the glazing panel. If additional holes were drilled for cleaning purposes, they would be sealed in a similar manner.

The filter 124 is designed so as to allow moisture to be expelled through the hole 118 as the air inside the air space expands, typically when the glazing panel is being heated, whether by the sun or by artificial means. Conversely, the filter 124 restricts ingress of water droplets as air is drawn back into the window as it cools. In this embodiment, the filter 124 comprises a membranous filter screen, such as stainless steel mesh containing 10,000 holes per square inch.

After insertion of the filter 124 and sealing of the other hole(s), condensation between the window panes will slowly dissipate, typically over a period of several weeks, as the window is exposed to sunlight. The end result is a glazing panel free of particulate matter and condensation.

Figure 4:
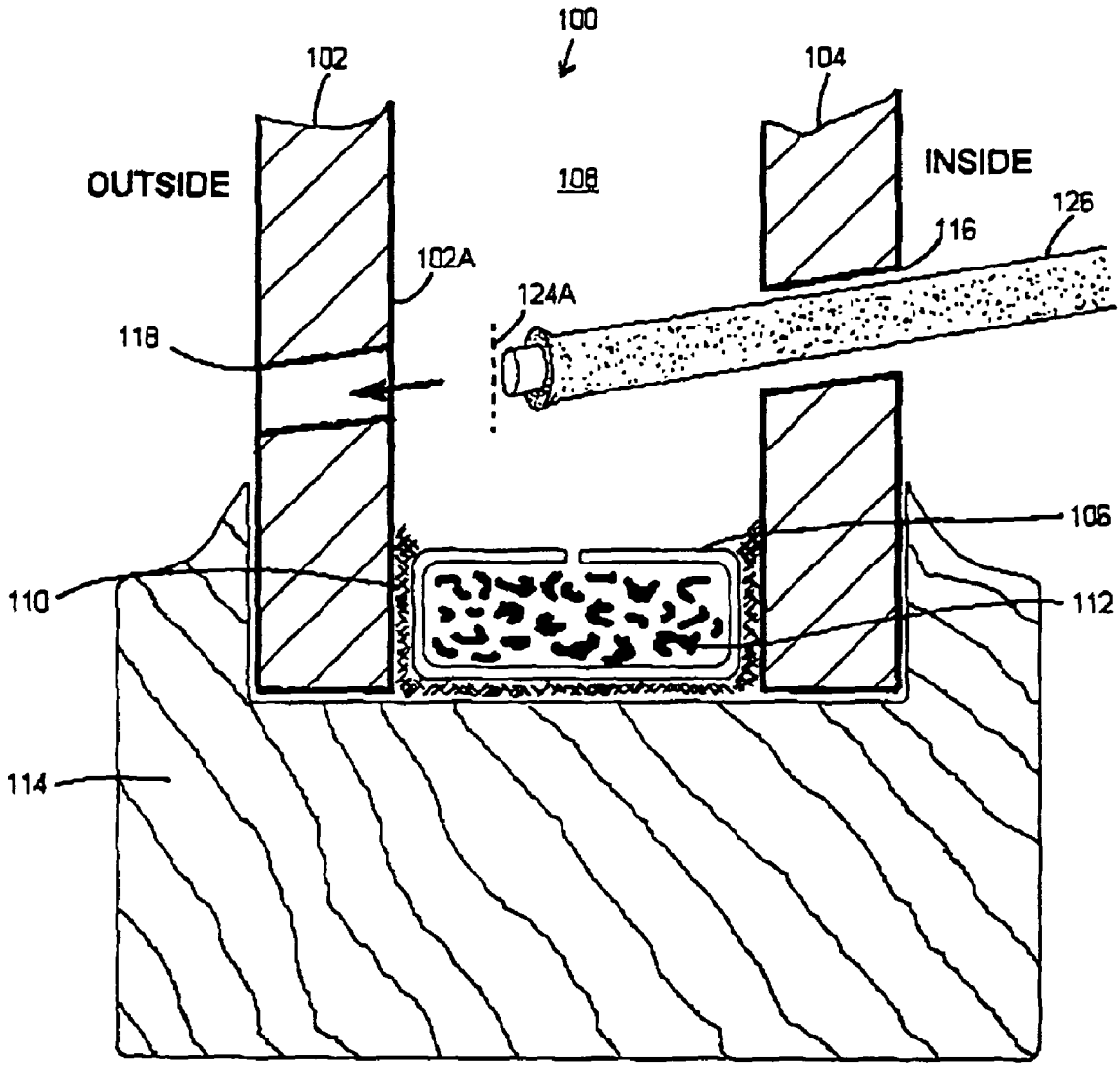
FIG. 4 is a cross-sectional view corresponding to FIG. 2 showing insertion of a different kind of filter.

FIG. 4 illustrates a modification, namely the use of a filter patch 124A applied to the interior surface 102A of pane 102 to cover the inner mouth of hole 118. The filter patch 124A may be a flat piece of stainless steel mesh as described above and inserted using the same probe 126. In this case, the filter mesh may be self-adhesive, i.e. with contact adhesive applied to its margins, and simply pressed into contact with the inner surface 102A.

Alternatively, the filter may comprise a piece of the aforesaid mesh and be pressed into contact with adhesive previously applied to the interior edges of hole 118 using a probe with a swab on the end. As before, once the filter is adhered, it will detach from the magnetic tip 128 as the probe is removed. The access hole 116 (and any cleaning holes) will be sealed as previously described.

The cleaning solution is preferably applied at moderate pressure using an air compressor unit. Distilled water may be used to remove contaminants deposited by water followed by rinsing with a solution of alcohol to dissolve and evaporate any residual water. If any contaminants remain after washing with water, the window is treated with a cleaning solution of vinegar/water solution. The acidity of the vinegar aids in dissolving metal containing contaminants such as aluminum oxide or zinc oxide. After treatment with vinegar, the panes are washed with water, followed by alcohol to remove residual water. If white "riverbed" marks are present on the internal surface of the panes, a vinegar/water solution may be used instead of alcohol to wet the window when drilling the access hole.

Although the above embodiments describe the use of alcohol to rinse off glass cuttings, a magnet and magnetic "squeegee" blade may be used in addition to the alcohol wash to remove any cuttings that still remain after the washing.

The diameter of the drain hole depends on the thickness of the glass of the inner pane. Typically, the hole has a diameter of at least about 3 to 3.5 mm to allow a drain tube to enter. For thick glass, the hole diameter can be made equal to the thickness of glass which can be up to 5 mm or 6 mm.

Although the above embodiments describe a seal that covers the access hole 116 and the draining hole (if used), it should be appreciated that a plug or silicon sealant could be used instead or in addition.

As mentioned herein before, the hole in the inner pane 116 is larger than that of the outer pane in order to allow for a magnetic insertion device, specifically, a probe 126 (see FIG. 4) to be inserted through it. Also, by creating a small outer hole 118, water droplets are prevented from forming inside the hole. Both holes 118, 116 are angled downward toward the exterior of the panel with the hole in the outer pane being situated slightly below the hole in the inner pane. Since the outer hole 118 is positioned below the inner hole 116, any cleaning solution that is applied to the air space between the panes will drain outside the building through the outer hole.

Figure 5:
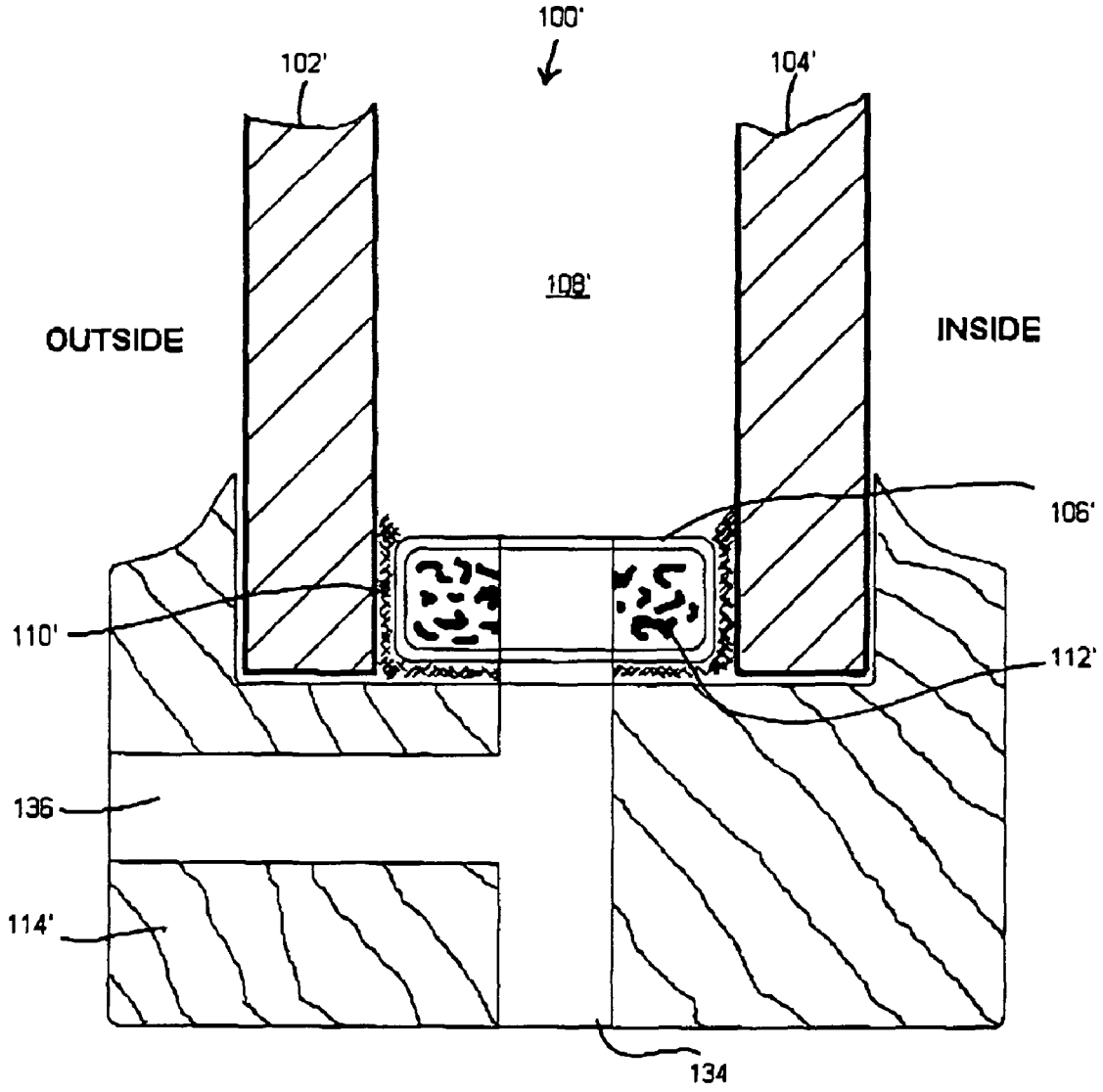
FIG. 5 illustrates application of the method to glazing panel having panes of tempered glass or other material that is not easily drilled.
Figure 6:
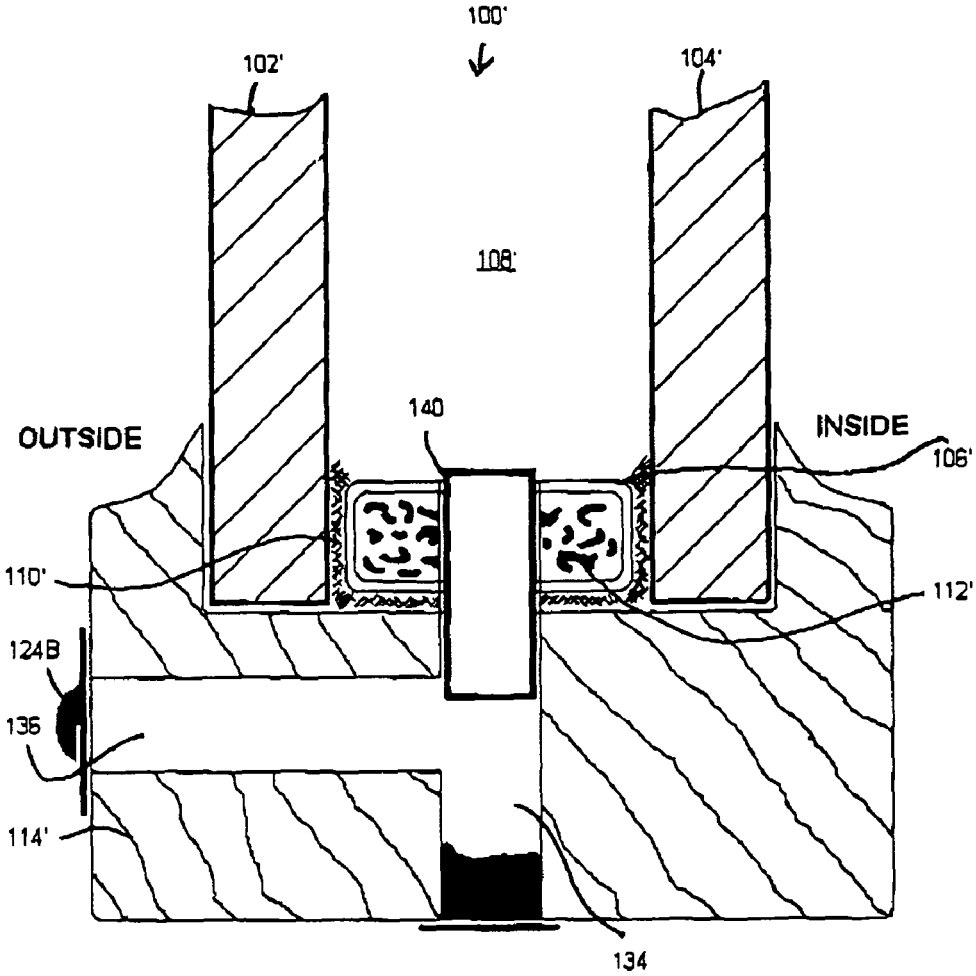
FIG. 6 is a cross-sectional view corresponding to FIG. 5 but after the panel has been treated and a filter patch applied.

FIGS. 5 and 6 illustrate a panel 100' having tempered glass panes 102' and 104' that is being treated according to a second aspect of the invention. The panel is generally similar to that shown in FIG. 1 but, because the tempered glass cannot readily be drilled, access to the air space 108 is achieved by drilling through the surrounding frame 114'. A first hole 134 is drilled through the frame 114' and the peripheral separator/seal 106'/110' from the outer edge of the panel, i.e., generally parallel to the planes of the glass panes 102' and 104'. A second hole 136 is drilled from the face 138 of the frame 114', generally perpendicular to the first hole 134, to communicate with it. Any cleaning of the interior of the panel is carried out as previously described.

Referring to FIG. 6, a short tube 140, for example of metal or plastic, is inserted into the first hole until it extends through the separator 106' and prevents desiccant 112' leaking into the air space. The outer end of hole 134 is sealed with a plug and/or patch and/or sealant and a filter is applied to close the second hole 136.

Figure 7:
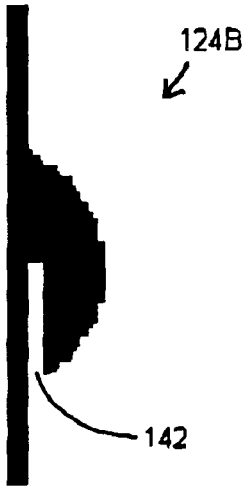
FIG. 7 is a side view of a domed filter patch as used in the embodiment illustrated by FIGS. 5 and 6.

The filter patch could take any of the forms described herein before but FIG. 6 shows a patch 124*b* with a central dome surrounded by flat margins. The margins are adhered to the surface of the frame so that the dome lies over the mouth of the hole 136. As shown in FIG. 7, a narrow slit 142 extends, parallel to the flat annular portion, around a part of the base of the dome. Preferably, when such a patch 124*b* is installed, the slit is directed downwards to that it is protected by the dome. The width of the slit is about 0.5 mm wide and about 4 mm long. Because it is so narrow, it provides the required filtering effect. Its length, however, is sufficient to provide the required open area. Although the slit of FIG. 7 is shown curved, it could of course be straight, if its length was still sufficient.

It should be appreciated that the filter slit could be combined with a filter screen, conveniently attached over the hole in the middle of the flat annular portion.

The arrangement described with reference to FIGS. 5 and 6 is especially suitable for glazing panels of patio doors, where the edge is accessible for drilling of the first access hole, but the filter is applied to the surface facing the exterior where it will not be obscured. For instance, such an arrangement would not be suitable if the patio door is closed against the frame. It will be appreciated that, if there is no desiccant, the tube can be omitted.

Figure 8:
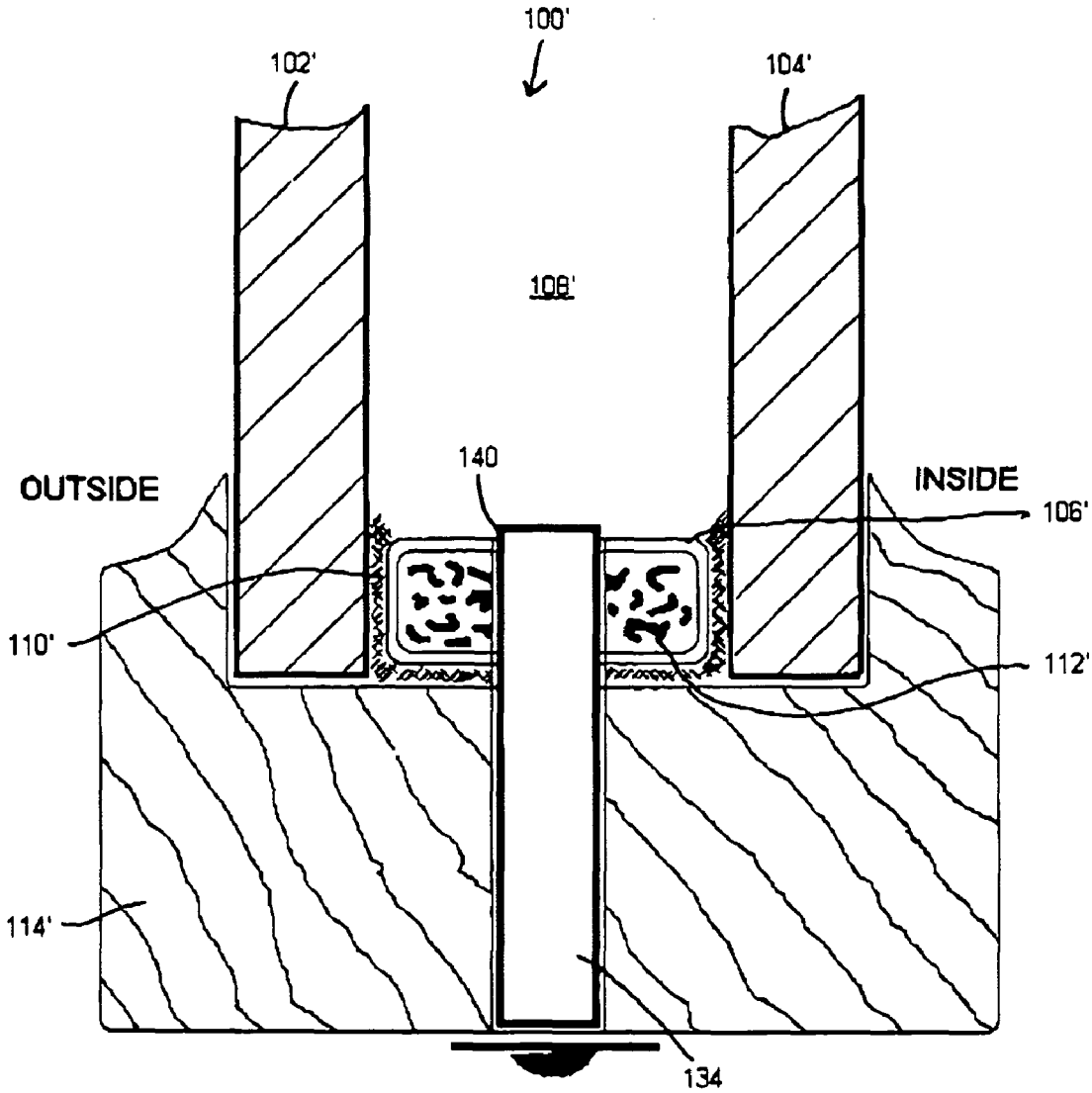
FIG. 8 is a cross-sectional partial side view corresponding to FIG. 6 but illustrating a modification.

If a panel having tempered glass panes is installed in such a way that the edge if accessible to the outside air, it may not be necessary to drill the second hole 136 from the surface of the frame. As shown in FIG. 8, in such a case, the filter is applied to the external mouth of hole 134 and, if desiccant is involved, the lining tube 140' may extend throughout the length of the hole 134.

Figure 9:
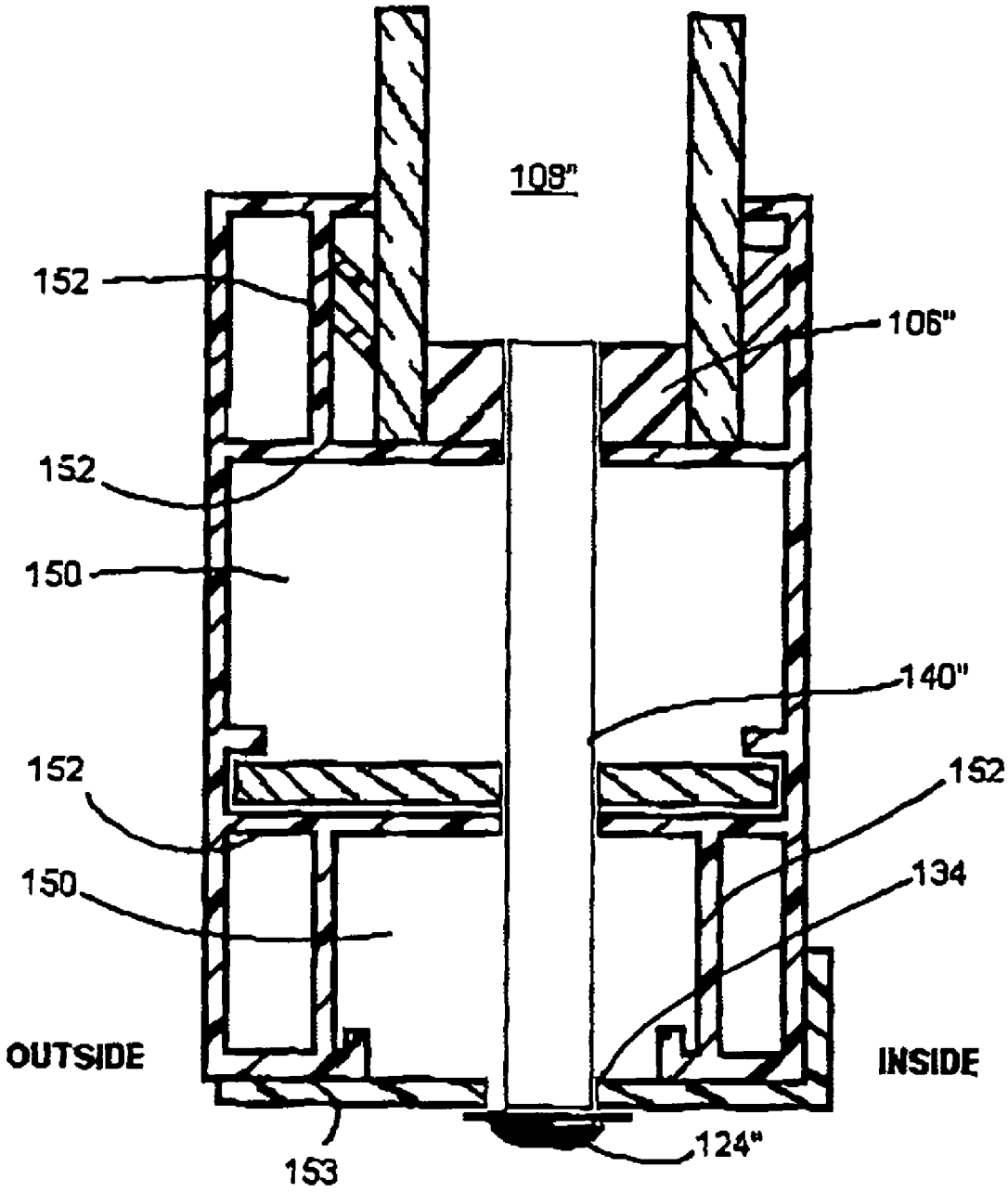
FIG. 9 is cross-sectional view through apart of a glazing panel illustrating application of the invention to a panel supported by a hollow frame.
Figure 10:
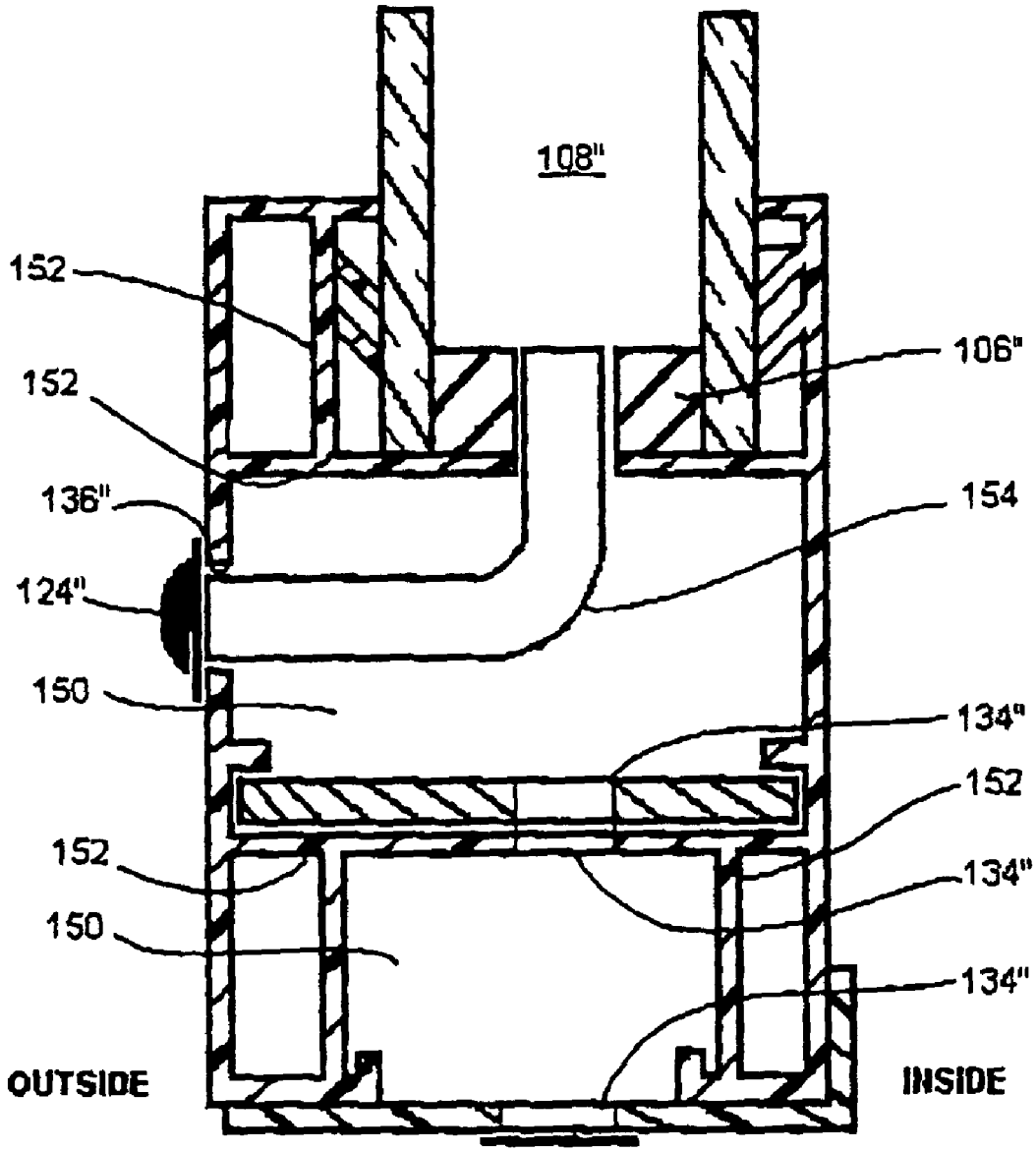
FIGS. 10 and 11 correspond to FIG. 9 but illustrate alternative methods of applying the invention to a panel supported by a hollow frame.
Figure 11:
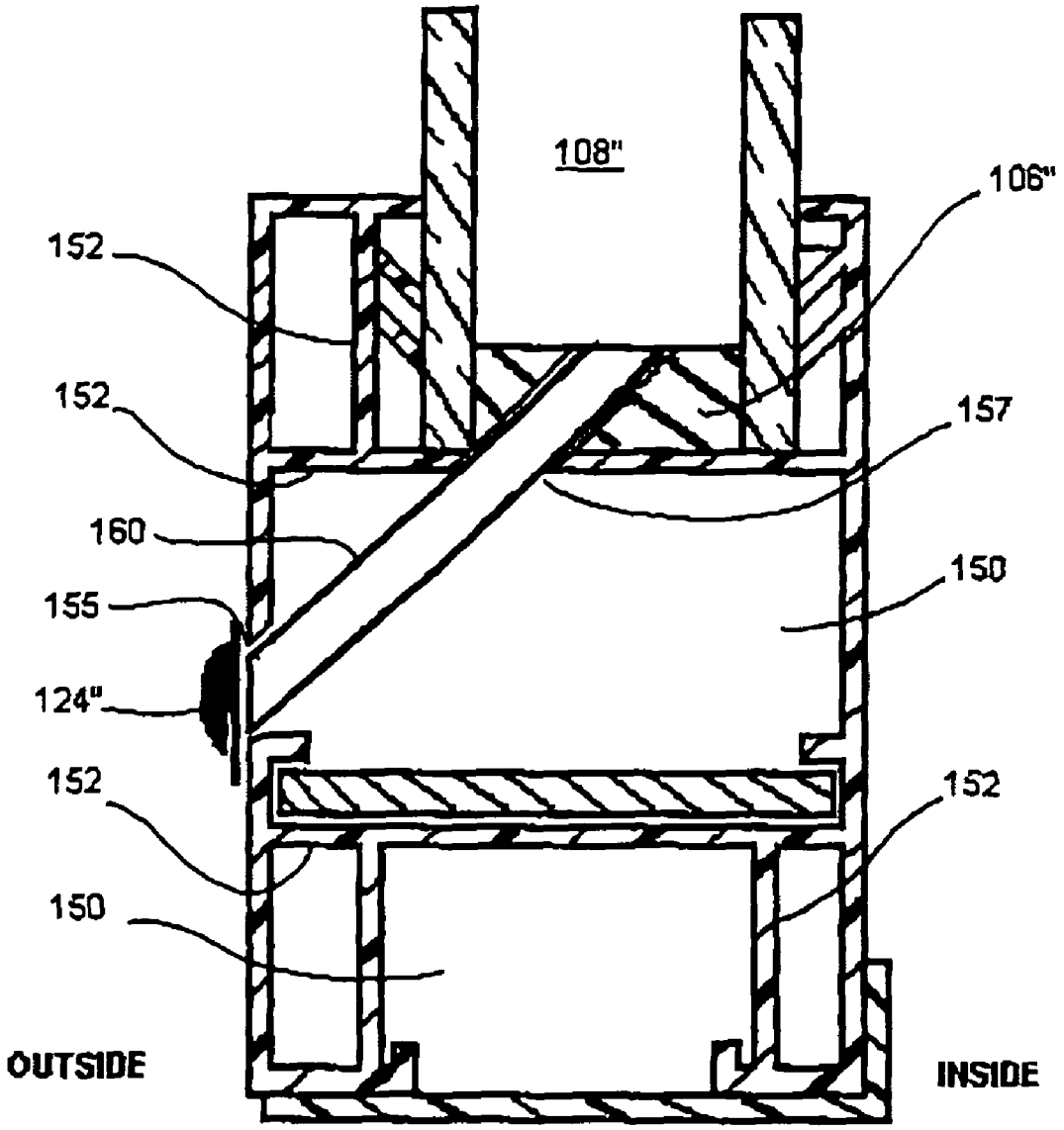

FIGS. 9 to 11 illustrate application of the invention to a glazing panel having a surrounding frame that is hollow, for example an extrusion of aluminium or plastics material. As shown in FIG. 9, such a frame typically has several compartments 150 formed by intersecting structural webs 152. In this case, the edge of the panel is accessible, so, drilling from the outer edge of the frame, a series of hole 134" are drilled through the intervening webs 152, respectively, through the separator 106" (and desiccant if applicable) and into the air space 108". After any required cleaning etc., a tube 140" is inserted through the aligned holes 134"to close off the compartments. The hole 134 in a flange 153 along the outer edge of the frame then is covered by a filter 124", which is shown domed but may take any suitable form disclosed herein.

FIG. 10 illustrates an alternative arrangement for use where the filter should not be applied to the outer edge of the frame. In this case, the first holes 134" are drilled from the edge of the hollow frame and a second hole 136" (or more if there are intervening webs) is drilled from the face of the frame generally perpendicularly to the first series of holes. In this case, a curved tube 154 is inserted through the second hole 136", any intervening holes, and into the hole in the separator 106". Such curved tube then closes off the both the separator 106", to avoid leakage of desiccant, and the frame, to avoid leakage of air. The filter 124" is applied over the hole 136" and the end of tube 154.

FIG. 11 illustrates an alternative to the arrangement of FIG. 10. In the arrangement shown in FIG. 11, the frame is drilled obliquely from the front face to provide a series of aligned holes 155 and 157 allowing the air space to communicate with the ambient. A tube 160, having suitably chamfered ends, is inserted into the obliquely aligned holes to seal the separator 106" and the compartment(s) 150. The tube 160 is closed by a filter 124", as before.

It should be appreciated that drilling through the frame instead of the pane(s) is not limited to use where the panes are tempered glass but could also be applied in other situations, for example where the panes are of plastics material or have a film of solar filter material applied.

Although only one draining hole and one filtering hole have been shown and described in the specific embodiments, it should be appreciated that more than one of each hole may be provided to facilitate the evacuation of particulate matter, moisture, cleaning solution and rinsing solution provided that at least one of the holes on the outside pane or outside frame is covered by a filter and all holes on the inside pane or side frame are hermetically sealed. The other holes on the outside may also have a filter, or may be hermetically sealed.

Figure 12A:
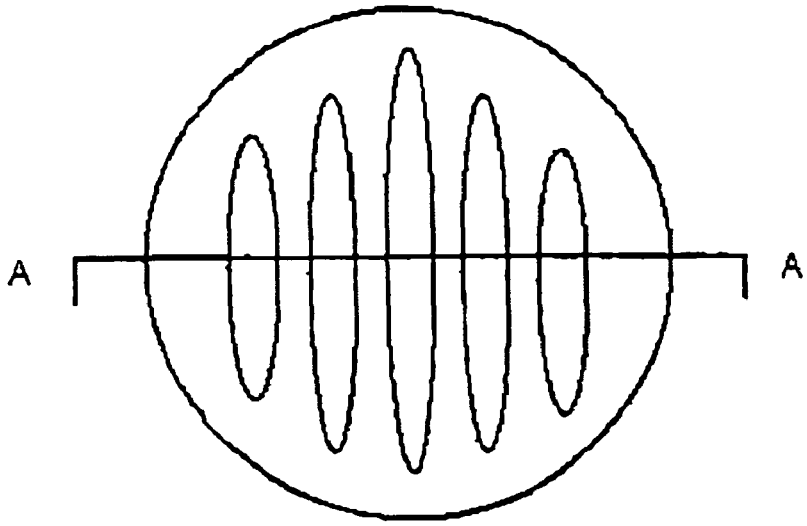
FIGS. 12(*a*), 12(*b*) and 12(*c*) are plan, transverse cross-section and perspective views, respectively, of a generally dome-shaped and corrugated filter.
Figure 12B:
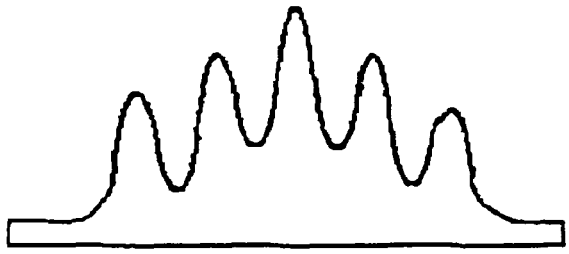
Figure 12C:
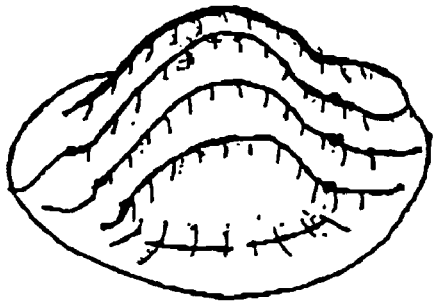

FIGS. 12(*a*), 12(*b*) and 12(*c*) illustrate a corrugated filter having an increased surface area in relation to the perimeter of the opening of the hole over which it is attached. Specifically, the surface area of the membranous screen is greater than the cross-sectional area of the hole. The corrugated portion may be surrounded by a flat margin to facilitate its adhesion to the pane.

Figure 13:
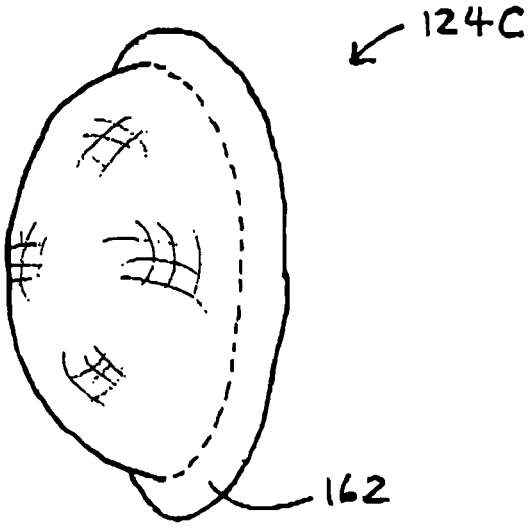
FIG. 13 is a perspective view of a plain, dome-shaped filter.
Figure 14A:
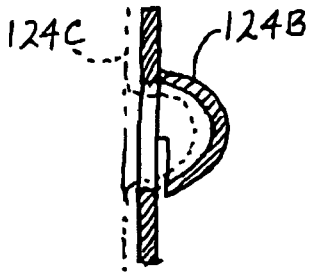
FIG. 14A is a cross-sectional side view of a dome-shaped slit filter combined with a dome-shaped mesh filter.
Figure 14B:
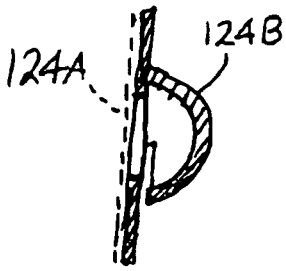
FIG. 14B is a cross-sectional side view of a dome-shaped slit filter combined with a flat mesh filter.

FIG. 13 depicts a dome-shaped filter 124C having a brim portion 162 whereby it can be attached to the surface of the pane around the vent hole. As disclosed above, contact adhesive would be applied to the brim 162 and/or to the rim around the hole. Such filter 124C can be used in place of the flat filter 124A of FIG. 4 or the slitted dome filter 124B of FIGS. 6 to 11. For additional protection, for example in case the filter is subjected to a particular dirty environment or high pressure water, say from a hosepipe, the filter 124C of FIG. 13 could be combined with the filter 124B of FIG. 7, i.e., the dome-shaped mesh could be inserted into the annular hole to fit over the vent hole in the pane. Such a modification is shown in FIG. 14A. FIG. 14B shows a similar protective arrangement wherein the dome-shaped slit filter 124C is combined with a flat filter 124A. In the latter case, the filter mesh is shown as having the same diameter as the brim 162 but it should be appreciated that it could be smaller, so long as it covered the hole in the pane. In either case, adhesive could be applied to the brim/mesh and/or the rim of the vent hole.

It will be apparent that the method of applying the filter to a patio door unit may additionally comprise the step of applying cleaning solution to the internal air space. Furthermore, a draining hole may be formed in the bottom of the pane to drain excess fluid.

It should be noted that certain embodiments of the invention are applicable to new glazing panels which have not been contaminated. During manufacture of the panels, the requisite holes could be drilled and the filter installed, with tube inserts as appropriate. It will be appreciated that access to the outer pane, i.e., that which will be the outer pane when the panel is installed, will not be restricted and the panel may well be clean and dry, so only the vent hole need be drilled. Such panels would be less likely to suffer from the ingress of moisture or other contamination if they developed a leak since the air would tend to vent via the filter as the panel heated and cooled.

It should also be noted that glazing panels equipped with filters as described herein, especially from new, would be less susceptible to damage from pressure changes, which is a problem encountered in certain environments. Such pressure changes can occur during cold weather or during changes in elevation e.g., due to transportation of the glazing panels by air or in mountainous regions.

It should be appreciated that use of the filters described with reference to FIGS. 3, 4, 7, 12(*a*) to 12(*c*) and 13 is not limited to the specific methods described herein, but could be used in other window treatment applications, for example, as described in the above-mentioned Canadian patent No. 1,332,541.

In practice, the stainless steel mesh used in filters according to all aspects of the invention can contain 10,000 holes per square inch. This gauge is particularly suitable since it will pass moisture laden air at elevated temperatures when the air layer is venting to the exterior, but will inhibit the ingress of moisture droplets at lower temperatures, preventing the formation of condensation within the panel. It is envisaged, however, that the number of holes per square inch could be anywhere in the range of 6,000 to 20,000. Also, the interstices in the mesh may be chemically formed by applying chemicals that erode the filter surface to create holes.

The above-described embodiments of the present invention are described as examples only. Alterations, modifications and variations may be effected to the particular embodiments by those of skill in the art without departing from the scope of the invention, which is defined solely by the appended claims.

The invention claimed is:

1. A glazing panel treatment method for either or both of removing contamination from an enclosed air space of the glazing panel and inhibiting ingress of contamination into an enclosed air space of the glazing panel, the glazing panel comprising at least an exterior pane and an interior pane and spacing and sealing means extending around and sealing the perimeters of the panes to form said enclosed air space therebetween, said method comprising the steps of:

(i) creating an access hole in the interior pane from its surface furthest from the exterior pane, said access hole communicating with the air space;

(ii) through the access hole, creating a vent hole in the exterior pane through which vent hole the air space communicates with ambient air;

(iii) applying a filter means to the vent hole to filter air passing therethrough; and (iv) sealing the access hole;

wherein the vent hole is located at a position lower than that of the access hole.

2. A method according to claim 1, wherein, prior to the step of creating the vent hole, cutting fluid is injected into the air space at least to a level to contact a cutting tool used to create the vent hole.

3. A method according to claim 1, wherein the filter means is inserted into the vent hole and retained therein by resilient engagement between the filter means periphery and the interior of the vent hole.

4. A method according to claim 3, wherein the filter means comprises magnetic material and is inserted by means of a probe having at least a tip portion that is magnetic, the filter means being attached magnetically to the magnetic tip portion which then is inserted through the access hole until the filter means is in the vent hole with its periphery engaging the interior of the hole, and the probe withdrawn, whereupon the filter means disengages from the tip portion.

5. A method according to claim 1, wherein the filter means comprises magnetic material and is inserted by means of a probe having at least a tip portion that is magnetic, the filter means being attached magnetically to the magnetic tip portion which then is inserted through the access hole until margins of the filter means adhere to the pane material surrounding the vent hole, whereupon the tip portion is withdrawn and the adhered filter means disengages from the tip portion.

6. A method according to claim 5, wherein the filter means has adhesive applied to the margins before insertion.

7. A method according to claim 5, wherein adhesive is applied to the pane material surrounding the vent hole before the filter means is inserted.

8. A method according to claim 1, wherein the step of applying the filter means comprises applying a filter means having marginal regions and a medial membranous filter screen by attaching the marginal regions to the pane material around the vent hole so that the medial membranous filter screen extends across the vent hole, said filter screen having interstices sized to permit the egress of moisture-laden air from the air space when the air space temperature and pressure are elevated relative to ambient and to inhibit ingress of moisture droplets with ambient air when the temperature and pressure of the air in the air space are less than ambient.

9. A method according to claim 1, wherein the filter means is installed bypassing the filter means through the access hole, and adhering the filter to the internal surface of the exterior pane surrounding the vent hole so that the filter means covers the vent hole.

10. A method of treating a glazing panel according to claim 1 wherein the filter means is a patch that extends across the vent hole.

11. A method of treating a sealed glazing unit installed into a surrounding frame and comprising at least an exterior pane and an interior pane and spacing and sealing means extending around and sealing the perimeters of the panes to provide an air space therebetween, the frame having a side face adjacent each pane and an edge surface generally perpendicular to the panes and directed outwardly therefrom, the method comprising the steps of:

(i) creating a vent hole having a first portion and a second portion, the first portion of the vent hole extending through the frame from said edge surface and through the spacing and sealing means, said first portion of the vent hole communicating at one end with the air space, and the second portion of the vent hole extending from a said side face of the frame to communicate with the first portion of the vent hole, such that the vent hole provides air flow communication through the frame and between the air space and ambient;

(ii) installing a filter means to close the second portion of the vent hole and filter air passing between the air space and ambient; and (iii) sealing the first portion of the vent hole exteriorly of the position at which it communicates with the second portion of the vent hole.

12. A method according to claim 11, for use where the spacing and sealing means comprises a tubular spacer containing desiccant, and further comprising the step of inserting a tube into the first portion of the vent hole to extend through the tubular spacer and inhibit leakage of the desiccant therefrom.

13. A method according to claim 11, for use where the frame comprises a hollow extrusion having compartments defined by structural webs, further comprising the step of inserting a tube through the frame, the tube communicating between the air space and ambient while sealing said compartments therefrom.

14. A glazing panel treatment method for either or both of removing contamination from an enclosed air space of the glazing panel and inhibiting ingress of contamination into an enclosed air space of the glazing panel, the glazing panel comprising at least an exterior pane and an interior pane and spacing and sealing means extending around and sealing the perimeters of the panes to form said enclosed air space therebetween, said method comprising the steps of:

(i) creating an access hole in the interior pane from its surface furthest from the exterior pane, said access hole communicating with the air space;

(ii) through the access hole, creating a vent hole in the exterior pane through which vent hole the air space communicates with ambient air;

(iii) applying a filter means to the vent hole to filter air passing therethrough; and (iv) sealing the access hole;

the filter means comprising magnetic material and being inserted into the vent hole by means of a probe having at least a tip portion that is magnetic, the filter means being attached magnetically to the magnetic tip portion which then is inserted through the access hole until the filter means is in the vent hole with its periphery engaging the interior of the hole, and the probe withdrawn, whereupon the filter means disengages from the tip portion and is retained in the vent hole by resilient engagement between the filter means periphery and the interior of the vent hole.

* * * * *